United States Patent [19]

Rickard

[11] 4,263,856

[45] Apr. 28, 1981

[54] PROVIDING SUPPLEMENTAL PULVERIZED COAL FOR LOAD REGAIN

[75] Inventor: Earl K. Rickard, East Granby, Conn.

[73] Assignee: Combustion Engineering, Inc., Windsor, Conn.

[21] Appl. No.: 8,665

[22] Filed: Feb. 8, 1979

[51] Int. Cl.[3] ..... F23C 1/10

[52] U.S. Cl. ..... 110/261; 110/104 B; 110/263; 110/347

[58] Field of Search ..... 110/263, 265, 347, 101 R, 110/103, 106, 260, 261

[56] References Cited

U.S. PATENT DOCUMENTS

| | | | |
|---|---|---|---|
| 738,131 | 9/1903 | Weaver | 110/263 |
| 1,042,576 | 10/1912 | Lindhard | 110/263 |
| 1,179,784 | 4/1916 | Von Porat | 110/263 |
| 1,354,741 | 10/1920 | Harder | 110/263 |
| 1,559,220 | 10/1925 | Caracristi | 110/106 |
| 1,562,411 | 11/1925 | Caracristi et al. | 110/106 |
| 2,053,340 | 9/1936 | Kennedy | 110/263 |
| 2,427,903 | 9/1947 | Crites | 110/106 |
| 3,881,857 | 5/1975 | Hoy et al. | 110/347 |

*Primary Examiner*—Henry C. Yuen

*Attorney, Agent, or Firm*—William W. Habelt

[57] ABSTRACT

An apparatus and method for maintaining the heat input to a pulverized coal-fired steam generator when firing a lower grade coal than for which the pulverizers were designed. A dense phase pulverized coal stream consisting essentially of a mixture of pulverized coal and air having an air-to-coal weight ratio below approximately 1.0 is injected into main pulverized coal stream, thereby providing the necessary supplemental fuel for maintaining the heat input at that full load level.

3 Claims, 4 Drawing Figures

PROVIDING SUPPLEMENTAL PULVERIZED COAL FOR LOAD REGAIN

BACKGROUND OF THE INVENTION

The present invention relates to pulverized coal furnaces designed as direct fired systems and more particularly to an apparatus and method for maintaining the heat input to the furnace at the design level when firing coal of lower grade than the pulverizers were designed for. Specifically, this invention is directed to an apparatus and method for injecting a dense phase pulverized coal stream into the main coal/air stream discharged from the pulverizer.

During the past few years there has been an increase in the use of western coal in steam generating units because of its ready availability and low sulfur content. Western coals are typically of the bituminous and lignite ranks and have lower heating values, lower grindability, and higher moisture content that their eastern bituminous coal counterparts. Since pulverizer capacity, i.e., the pounds per hour of coal discharged from the pulverizer, is directly dependent upon the grindability and moisture content of the coal, the capacity of a given pulverizer is substantially less when grinding a western coal than when grinding an eastern coal. Additionally, pulverizer output, i.e., the heat content of the coal discharged from the pulverizer to the burners, is even further decreased as a result of the pulverizer discharging less pounds of the lower heating value western coal than of the higher hearing value eastern coal. Accordingly, a utility would generally experience a decrease in generating capacity when switching from eastern coal to western coal.

The typical solution to the problem is to make major modifications in the steam generating unit by adding an additional pulverizer and an additional level of burners to the furnace in order to regain the generating capacity lost when switching to the western coal. However, such major changes necessitate that the unit be taken out of service for a significant period of time resulting in a substantial loss of generating capacity to the utility. In many cases, it is nearly impossible to add an additional pulverizer to a steam generating unit simply because of space limitations in the immediate vicinity of the furnace.

Therefore, a need exists for an apparatus and method of providing supplemental pulverized coal to the steam generator for load regain which permits an additional pulverizer to be remotely located, eliminates the necessity of adding an additional elevation of burners, and minimizes the downtime required for the change to be made.

SUMMARY OF THE INVENTION

The present invention overcomes the disadvantages of the prior art by providing for the injection of a supplemental fuel stream into the main pulverized coal stream to the burner. In accordance with the invention, the supplemental fuel stream is a dense phase pulverized coal stream consisting essentially of a mixture of pulverized coal and air having an air-to-coal weight ratio below 1.0.

Pulverized coal is supplied to a pulverized coal storage bin which, if necessitated by space limitations in the immediate vicinity of the furnace, may be remotely located from the furnace. When it is desired to operate the furnace at peak load, supplemental fuel is drawn from the pulverized coal storage bin and conveyed to the main fuel pipe as a dense phase stream of pulverized coal entrained in compressed air. At the main fuel pipe, the supplemental fuel stream is injected into the main coal/air stream flowing therethrough. In this manner, the supplemental fuel necessary to regain full load on the furnace can be injected into the furnace without disturbing the existing windbox and burner arrangements.

BRIEF DESCRIPTION OF THE DRAWINGS

The present invention may be better understood by reference to the accompanying drawings wherein.

DESCRIPTION OF THE PREFERRED EMBODIMENT

Figure 1:
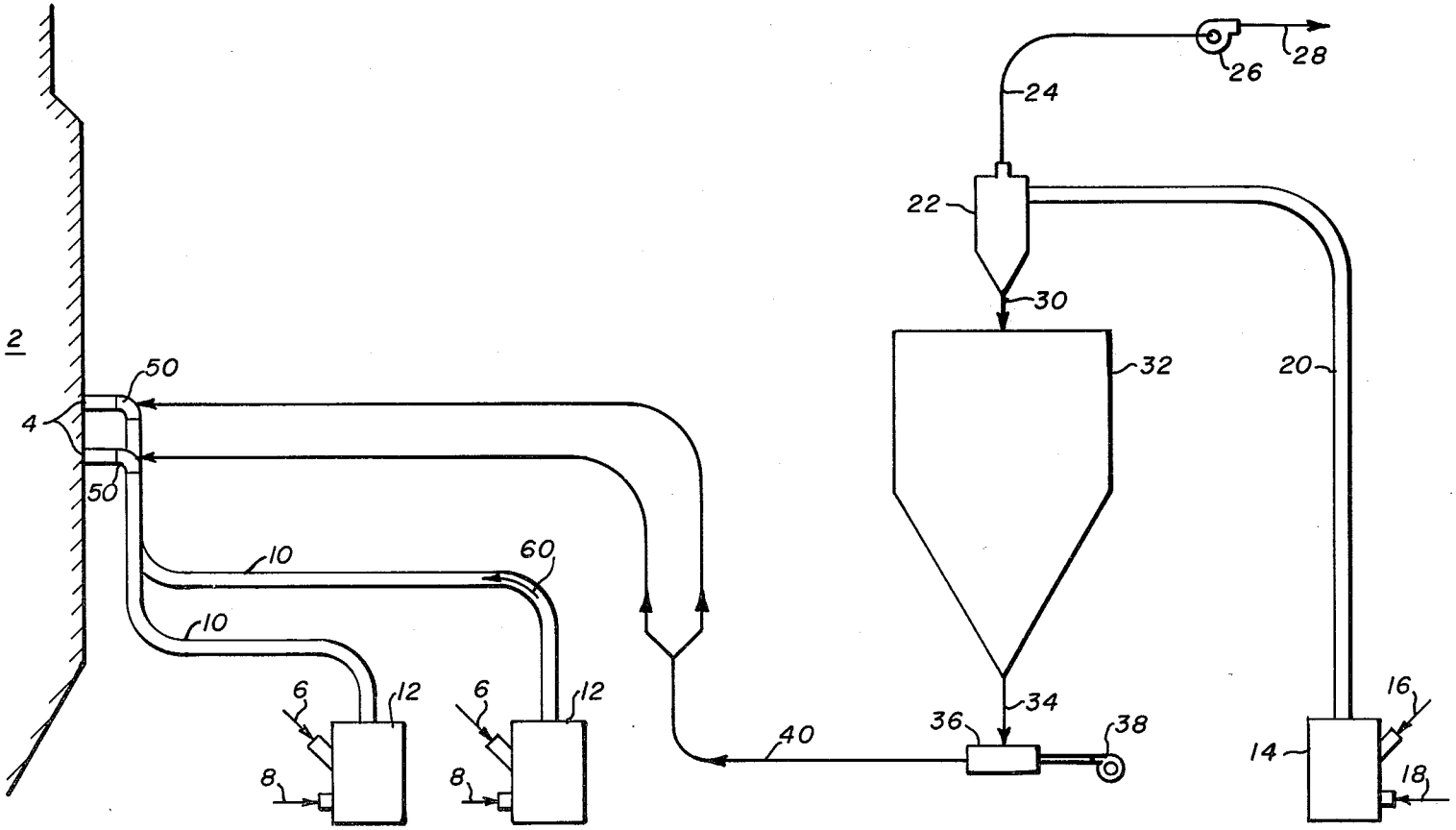
FIG. 1 is a diagrammatic representation of a supplemental fuel system which may be employed in the practice of this invention.

The apparatus shown in FIG. 1 constitutes a representative means for providing supplemental fuel to the burners in accordance with the present invention. The present invention utilizes a dense phase pulverized coal stream as the supplemental fuel. The dense phase pulverized coal stream is a dense phase coal/air mixture consisting essentially of pulverized coal entrained in a transport air stream wherein the transport air-to-coal weight ratio is maintained below 1.0. Delivering the supplemental fuel to the burners as a dense phase coal/air mixture minimizes the transport air requirements for conveying the coal to the burners. Because a minimal amount of transport air is required with this dense phase concept, it is not necessary to change the existing unit windbox or burner arrangement to accommodate the additional air being supplied with the supplemental fuel.

Referring now to FIG. 1, a furnace 2 having a plurality of burners or coal nozzles 4 is shown with a load regain system designed in accordance with the present invention. To fire the furnace, raw coal is delivered to furnace pulverizers 12 thru raw coal feed 6. The raw coal is ground to pulverized coal therein and dried by hot air, termed primary air, drawn from the air preheater thru hot air duct 8. The pulverized coal is entrained in the hot air to form main coal/air stream 60 and conveyed thru main fuel pipes 10 to burners 4 for combustion in furnace 2. Although a single pulverizer 12 is depicted in FIG. 1 as supplying pulverized coal to a single burner 4, a single pulverizer 12 will generally serve a plurality of burners.

As stated previously, the capacity of a coal mill such as pulverizer 12 is related to the raw coal to be ground. Frequently today, poorer quality coal than the coal for which the coal mills were designed is being used. Often this results in a loss of load, i.e., generating capacity, on the furnace because the furnace pulverizers are incapable of supplying the required amount of pulverized coal.

In accordance with the invention, pulverized coal is drawn from storage bin 32 through line 34 to dense phase mixer 36 when supplemental fuel is required to regain full load on furnace 2. Line 34 may, for example, be a screw conveyor, a gravametric feeder, or a volumetric feeder. Dense phase mixer 36 receives pulverized coal from storage bin 32 through line 34 and mixes the pulverized coal with compressed air from compressed air supply 38 so as to establish a dense phase pulverized coal stream consisting essentially of a mixture of pulverized coal and air having an air-to-coal weight ratio below 1.0. Dense phase mixer 36 may be either a pulverized coal transport pump or simply a venturi pick-up device.

The dense phase pulverized coal stream established in dense phase mixer 36 is conveyed to main fuel pipe 10 through line 40 by the pressure of the compressed air. In the preferred embodiment as shown in FIG. 1, the dense phase coal/air mixture is injected into main fuel pipe 10 at the main fuel pipe outlet elbow 50. The dense phase pulverized coal stream injected into main fuel pipe outlet elbow 50 mixes with the main coal/air stream 60 discharged through the main fuel pipe 10 from pulverizers 12 and is discharged to burner 4 for combustion in furnace 2, thereby providing the desired load regain.

Pulverized coal may be supplied to the pulverized coal storage bin 32 through either a separate storage system pulverizer, or one of the existing furnace pulverizers or even by truck. In the preferred embodiment, as shown in FIG. 1, pulverized coal is supplied to pulverized coal storage bin 32 through a separate storage system pulverizer 14. To fill the storage bin, raw coal is delivered to storage system pulverizer 14 through raw coal feed 16. The raw coal is ground to pulverized coal in storage system pulverizer 14 and dried by hot air drawn from the air preheater or by hot flue gas drawn from the economizer section of the boiler and conveyed to storage system pulverizer 14 through hot gas duct 18. It is generally preferred to use hot flue gas to dry the coal pulverized for subsequent storage in order to minimize the possibility of fires in the storage system.

The pulverized coal is entrained in the hot air or flue gas and conveyed through fuel pipe 20 to separator 22. The function of separator 22 is to separate out the air or flue gas that has entrained the coal in pulverizer 14. The air or flue gas leaves separator 22 through line 24 to suction fan 26. Suction fan 26 boosts the air or flue gas pressure to a level sufficiently above atmospheric so that the air or flue gas may be vented to the atmosphere through line 28. Alternatively, suction fan 26 may be used to boost the air or flue gas to a pressure sufficiently higher than the furnace operating pressure so that the air or flue gas may be vented through line 28 to the furnace for subsequent combustion of any pulverized coal fines which may still be entrained in the air or flue gas leaving separator 22.

The pulverized coal removed from the air or flue gas stream in separator 22 passes through line 30 to pulverized coal storage bin 32. The pulverized coal remains stored in pulverized coal storage bin 32 until required as supplemental fuel in order to provide load regain for furnace 2 as described previously.

Figure 2:
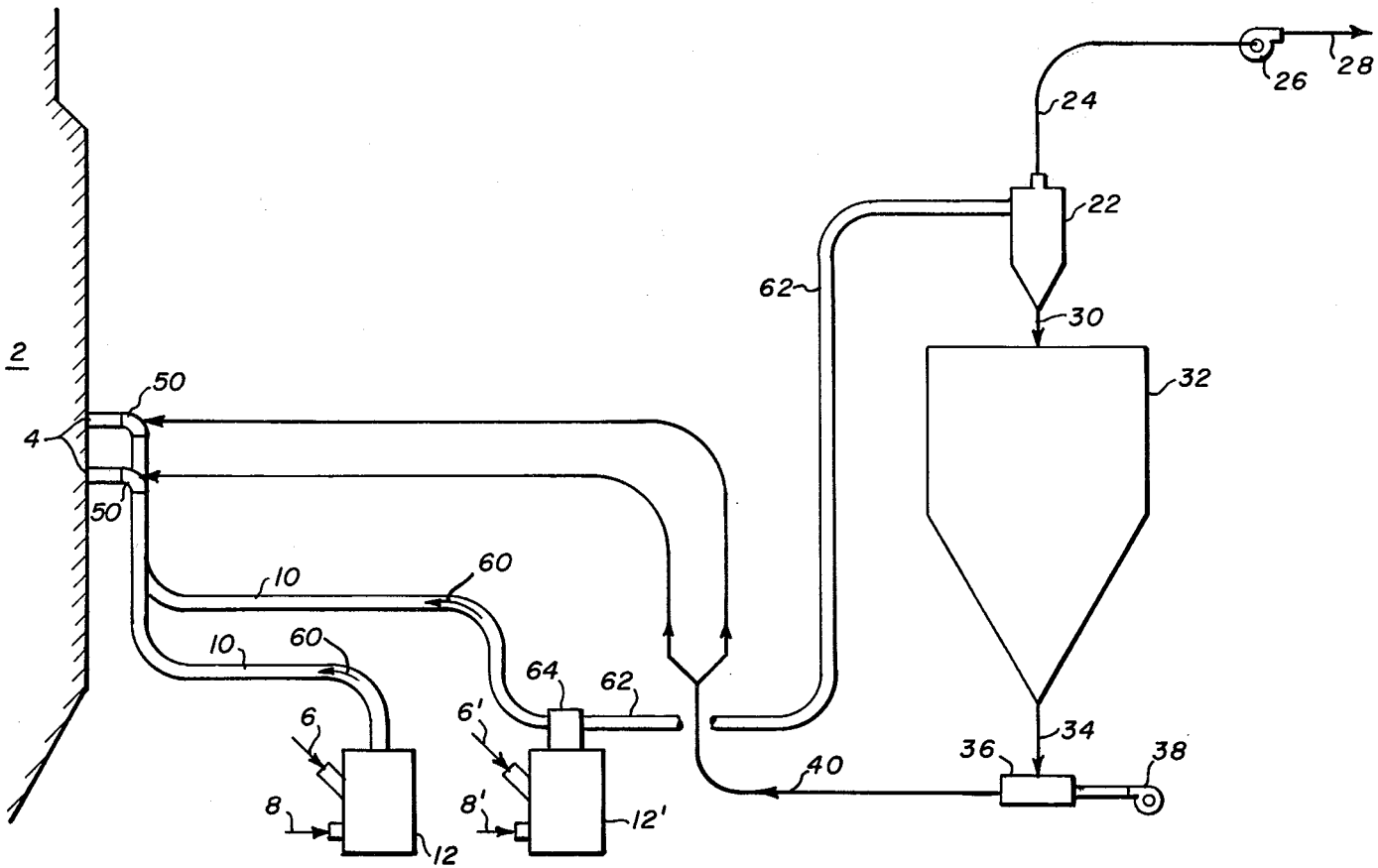
FIG. 2 is a diagrammatic representation of an alternate supplemental fuel system which may be employed in the practice of this invention.

Alternatively, an existing furnace pulverizer may be used to supply coal to pulverized coal storage bin 32. In such an arrangement, as shown in FIG. 2, one of the furnace pulverizers 12' would be used to supply pulverized coal to pulverized coal storage bin 32 when furnace 2 was operating at low load. In operation, raw coal is delivered to furnace pulverizer 12' through raw coal feed 6'. The raw coal is ground to pulverized coal in furnace pulverizer 12' and dried by hot air drawn from the air preheater or hot flue gas drawn from the economizer section of the boiler and conveyed to furnace pulverizer 12' through hot air duct 8'. The pulverized coal is entrained in the hot air or hot gas and diverted through diverter head 64 to fuel line 62 which conveys the pulverized coal entained in the hot air or hot flue gas to separator 22. The hot air or hot flue gas leaves separator 22 through line 24 to suction fan 26 which boosts the pressure of the hot air or hot gas to the required level preventing to the atmosphere or to the furnace itself as described above. The pulverized coal separated from the hot air or hot gas stream in separator 22 passes through line 30 to pulverized coal storage bin 32 for storage until needed as supplemental fuel.

Figure 3:
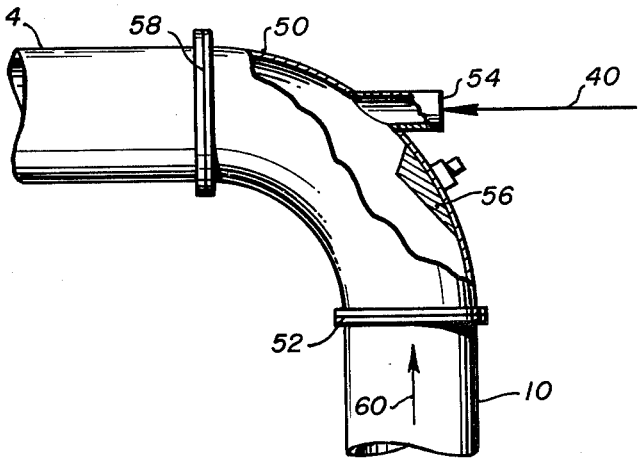
FIG. 3 is a cross-sectional view of the preferred embodiment of a main fuel pipe outlet elbow which incorporates an inlet for receiving the supplemental fuel.

Although the dense phase pulverized coal stream 40 may be injected into the pulverized coal entrained in the primary air stream leaving furnace pulverizers 12 at any location along the main fuel pipe 10, it is preferred that the dense phase pulverized coal stream be injected into the main fuel pipe 10 at main fuel pipe outlet elbow 50 as shown in FIG. 3. Main fuel pipe outlet elbow 50 has a first inlet 52 joined to the main fuel pipe 10 for receiving the main coal/air stream 60 from furnace pulverizer 12 and a second inlet for receiving dense phase pulverized coal stream 40 from pulverized coal storage bin 32. Both the dense phase coal stream, entering the main fuel pipe outlet elbow 50 through second inlet 54, and the main coal/air stream from furnace pulverizer 12, entering main fuel pipe outlet elbow 50 through first inlet 52, exit main fuel pipe outlet elbow 50 to burner 4 through common outlet 58. It is preferred as shown in FIG. 3 that the second inlet to the main fuel pipe outlet elbow 50 be coaxial with the common outlet 58.

Figure 4:
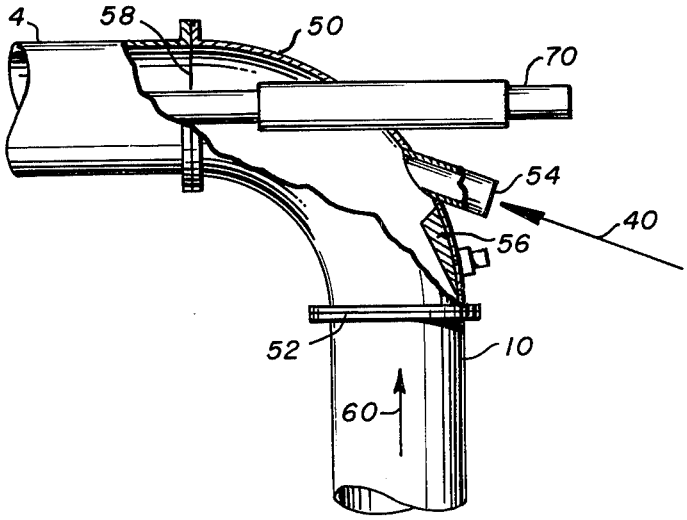
FIG. 4 is a cross-sectional view of an alternate embodiment of a main fuel pipe outlet elbow which incorporates an inlet for receiving the supplemental fuel.

An alternate embodiment of main fuel pipe outlet elbow 50 is shown in FIG. 4 where obstruction 70 prevents the second inlet 54 to main fuel pipe outlet elbow 50 from being located coaxial with the common outlet 58. Obstruction 70 may be any of a number of obstructions such as an adjustable throat plug or an oil-fired or gas-fired ignitor. In this embodiment, the second inlet 54 is located closer to the first inlet 52 and intersects main fuel pipe outlet elbow at an acute angle such that dense phase coal stream 40 is aligned to intersect the center region of the plane of the common outlet 58 to the main fuel outlet elbow 50.

It is further preferred that a deflector block 56 be positioned internally to and along the outer radius of main fuel outlet pipe elbow 50 between the first inlet 52 and the second inlet 54 as shown in both FIG. 3 and FIG. 4. The deflector block 56 serves to deflect the main coal/air stream entering the main fuel pipe outlet elbow 50 from furnace pulverizer 12 through the first inlet 52 thereby decreasing the possibility that this stream will interfere with the injection of the dense phase pulverized coal stream 40 entering through the second inlet 54.

What is claimed is:

1. An apparatus for providing supplemental pulverized coal for load regain on a pulverized coal-fired steam generator having a furnace, a burner for burning pulverized coal in the furnace, a pulverizer for pulverizing coal, and a main fuel pipe interconnected between the pulverizer and the burner for conveying a main coal/air stream consisting essentially of pulverized coal entrained in a primary air stream from the pulverizer to the burner, comprising:

a. a pulverized coal storage bin;

b. means for supplying pulverized coal to the pulverized coal storage bin;

c. mixing means for establishing a supplemental mixture of pulverized coal and air having an air-to-coal weight ratio below 1.0;

d. means for feeding pulverized coal from the pulverized coal storage bin to said mixing means whenever supplemental pulverized coal is required to regain load;

e. means for supplying compressed air to said mixing means;

f. a main fuel pipe outlet elbow having a first inlet joined to the main fuel pipe, a second inlet, and a common outlet joined to the burner;

g. a supplemental fuel line interconnected between said mixing means and the second inlet of said main fuel pipe outlet elbow for conveying the supplemental mixture of pulverized coal and air from said mixing means to said main fuel pipe outlet elbow.

2. An apparatus as recited in claim 1, wherein the second inlet to the main fuel pipe outlet elbow is coaxial with the common outlet.

3. An apparatus as recited in claim 2, wherein a deflector block is mounted on the inner surface of the outer wall of the main fuel pipe outlet elbow at a location between the first and second inlets.

* * * * *